United States Patent [19]

Nomura et al.

[11] Patent Number: 4,949,773

[45] Date of Patent: Aug. 21, 1990

[54] PRODUCTION METHOD OF A MOLD FOR CONTINUOUS CASTING

[75] Inventors: Hirotoshi Nomura; Tokumi Ikeda, both of Osaka, Japan

[73] Assignee: Techno Research Kabushiki, Osaka, Japan

[21] Appl. No.: 393,405

[22] Filed: Aug. 11, 1989

[30] Foreign Application Priority Data

Sep. 9, 1988 [JP] Japan ..... 63-227240

[51] Int. Cl.[5] ..... B22D 19/04

[52] U.S. Cl. ..... 164/91; 164/9; 164/46; 164/418

[58] Field of Search ..... 164/9, 10, 11, 34, 35, 164/36, 46, 47, 91, 98, 418, 459

[56] References Cited

U.S. PATENT DOCUMENTS 4,535,518 8/1985 Jaqua ..... 164/46

FOREIGN PATENT DOCUMENTS 2657474 6/1978 Fed. Rep. of Germany ..... 164/91

*Primary Examiner*—Richard K. Seidel

*Attorney, Agent, or Firm*—Flynn, Thiel, Boutell & Tanis

[57] ABSTRACT

This invention relates to a production method of a mold for continuous casting comprising the steps of: providing a cooled water path in the mold water cooling mechanism; filling the cooled water path with a wax; making the wax surface uniform; providing a copper or copper alloy stratum on the wax surface by electrolytic plating; removing wax from the cooled water path and uniting the mold water cooling mechanism with the mold as one; and comprising the additional step of providing a copper or nickel plating on the surface on which is provided the cooled water path in the mold water cooling mechanism before depositing wax in the path.

2 Claims, 4 Drawing Sheets

PRODUCTION METHOD OF A MOLD FOR CONTINUOUS CASTING

BACKGROUND OF THE INVENTION

1. Field of the Invention

This invention relates to a production method for a mold for the continuous casting of low carbon steel, high carbon steel, stainless steel and special alloy steel, and, furthermore, relates to a production method for a mold for continuous casting having a water cooling mechanism.

2. Description of the Prior Art

A mold for continuous casting, which is made of copper or a copper alloy, generally has good heat conduction properties and is equipped with a water cooling mechanism because ingot steel injected into the mold has a high temperature. With regard to molds for continuous casting having conventional water cooling mechanisms, there are the slit type, canal type and stud bolt type, named by the shape of the cooled water path on the reverse surface of the cast. Regarding the stud bolt type, the cast does not have a cooled water path, but is connected to the cooling water path by bolts. The slit type is more commonly used. FIG. 4 (*a*), (*b*) are exploded perspective views of the slit type water cooling cast. 1 is a back frame (a water case) comprising of iron or stainless material. The back frame 1 is divided into upper and lower half parts, the upper half part is connected to the cooled water inlet 2 and the lower half part is connected to the cooled water outlet 3. On the surface opposite to the back frame 1, the slits 5 are provided in a vertical orientation. The cooled water flows into the slits 5 from the lower half part of the back frame 1 through the water supplying channel 6 and flows out to the upper half part of the back frame 1 through the draining channel. The cast 4 is fixed to the back frame 1 by bolts 8. For this reason, penetration holes are required for the bolts 8 and a packing 9 is provided to prevent the leakage of water out of the back frame 1. An O-ring 11 is also required to prevent the leakage of water between the back frame 1 and the cast 4. Furthermore, installment holes 10 are required for the bolts 8. Accordingly, it is not possible to make slits in the place where the installment holes are made, and it is not always possible to make the slits of the cast at equally spaced intervals. This results in the cooling not being uniform.

FIG. 5 (*a*), (*b*) are exploded perspective views of the canal type water cooling mold. The difference between the canal and slit type is that, in the canal type, the cooling water path made in the mold 4 is not provided on the surface of the mold, but penetrates the interior of the mold. Accordingly, with regard to the canal type, the thickness of the plate of the mold tends to be greater than that in case of the slit type. The mold 4 and the back frame 1 are attached by bolts 8. Accordingly, it is required to provide both the mold 4 and the back frame 1 with bolt holes and to provide packings to prevent the leakage of water. It is also required to arrange the installment holes of the bolts 8 between the cooled water paths in the cast 4. Therefore, the pitch of the cooled water path cannot be as narrow as desired. This causes the cooling capability to lower.

FIG. 6 is an exploded perspective view of the stud bolt type water cooling mold. The difference between the stud bolt type and the former two cases is that its cooled water paths are not made on the side of the mold

4. In the stud bolt type, the cooled water paths are formed as slits on the surface of the back frame 1 opposite to the mold, the cooled water flows from the cooled water inlet 2, along the surface of the back frame 1 and the mold 4, and out of the cooled water outlet 3. On the surface of the mold 4, opposite the back frame 1, stud bolt holes 2 are provided and the bolts are inserted therein. The bolts 8 are inserted into the bolt holes 2, and fixed by the nuts 3 and packings 9. Furthermore, it is necessary to have an O-ring between the back frame 1 and the mold 4 to prevent the leakage of water.

In the above-mentioned conventional techniques, the water cooling mechanism and the mold are made separately and physically united prior to use. Accordingly, there have been the following problems in the use of the bolt type water cooling mold.

(a) Packings and an O-ring are required to prevent the leakage of water when the water cooling mechanism and the mold are united, and, when fatigued, the leakage of water may be increased.

(b) Installment holes and bolts are required on the reverse surface of the mold in order to unite the water cooling mechanism and the mold, therefore, a thicker copper or copper alloy material is required for the mold than which is originally needed, and further, the cooled water path cannot be located in the places where the installment holes etc. are set. Accordingly, the cooling is not uniform.

(c) Furthermore, since a thick copper or copper alloy material must be used, the cooled water path must be positioned in the interior or on the reverse surface of the mold by several methods. When the stud bolts are installed on the reverse surface of the mold, although the cooled water path is not placed in the mold in order to avoid the reduction of the plate thickness of the mold, the stud bolt processing takes a much longer time than the installation of the installment holes.

(d) To assemble the mold and the water cooling mechanism, processing is not only required on the side of the mold, but is also required to install the mold on the side of the water cooling mechanism.

SUMMARY OF THE INVENTION

The production method of a mold for continuous casting of the present invention has the characteristics in that, to solve the above-mentioned problems, the cooled water path (the slit) is provided on the water cooling mechanism of the mold (the back frame) during the assembling of the mold for continuous casting, and subsequently, the cooled water path is filled with a wax until a uniform surface is made, and, after depositing a copper or copper alloy stratum on the uniform surface by electric plating to unite the mold with the water cooling mechanism, the wax is removed from the cooled water path, and the water cooling mechanism.

Furthermore, it is preferred to provide a copper or nickel plating on the surface of the water cooling mechanism in which the cooled water path is made.

In the present invention, since the process is included in which we fill the cooled water path provided in the water cooling mechanism of the mold with wax, and a uniform surface is subsequently made, it is possible to make a copper or copper alloy stratum over the vacancy by electrolytic plating. If a copper or copper alloy stratum is used as the mold, it is possible to attach the water cooling mechanism and the mold securely and water tightly, without the use of packings, installment holes and bolts etc., during the plating. Since it is possible to easily remove the wax from the cooled water path by heating, water can flow in the cooled water path by removing the wax after the electrolytic plating. Because the cooled water path can be arranged without any regard to the placement of installment holes and bolts, non-uniform cooling is prevented. Also, since installment holes and bolts are not required, the mold thickness can be freely determined.

Furthermore, it is preferred that a copper or nickel plating is applied on the surface of the water cooling mechanism of the mold on which the cooled water path is provided in order to prevent corrosion of the water cooling mechanism, before filling the cooled water path with wax.

OBJECT OF THE INVENTION

It is the object of the present invention to provide a production method for a mold for continuous casting which has uniform cooling, no limitations with respect to its thickness, and permits the uniting of the mold and the water cooling mechanism without the use of packings, installment holes and bolts during the plating.

DESCRIPTION OF THE PREFERRED EMBODIMENT

Figures 1A, 1B, 1C, 1D:
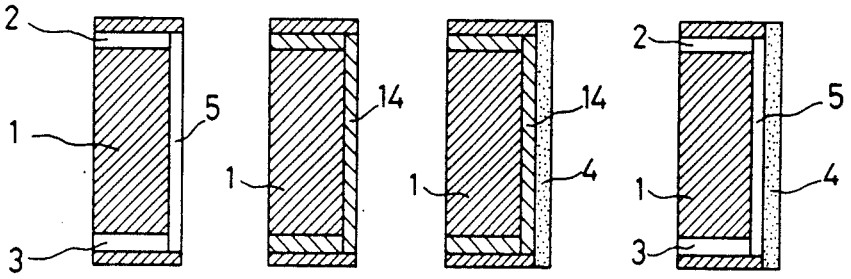
FIG. 1 (*a*)–(*d*) are sectional views explaining the production method of the invention.

FIG. 1 (*a*)–(*d*) are the sectional views explaining the production of the water cooling mold for continuous casting of the present invention. The various process steps are explained as follows.

The Processing Step (See FIG. 1 (*a*))

First, we process the back frame 1. Slits 5 are formed as cooling water paths on the surface of the back frame 1 where the back frame 1 is to be united with the mold 4. The cooling water paths (slit 5) are connected to a cooled water inlet 2 and to a cooled water outlet 3. We may utilize iron or stainless material as the back frame material. When using an iron material, if a plating for rust proofing is applied on the places to be the cooled water path beforehand, there is no problem of generating rust during the process thereafter under real use. When using a stainless material, because the coating of the passive state is minute, it is difficult to activate the silver thin layer without having the silver thin layer collapse or dissolve, when a plating is applied in a subsequent process step after forming the sliver thin layer. Consequently, it is preferable to previously cover the surface to be plated with a copper or nickel plating.

Degreasing Process

In this process, we degrease the back frame 1 with an organic solvent (for example trichlene (trichloroethylene), perchlene (perchloroethylene), 1,1,1-trichlorethane etc.) by cool temperature dipping, steam, spary etc. or give it an alkali degreasing or alkali electrolytic degreasing. In short, we may perform degreasing using an organic solvent together with alkali degreasing or alkali electrolytic degreasing to activate the back frame surface. Thereafter, a copper or nickel plating is applied. The thickness of the plating should be more than 10 μm. When the coating is less than 10 μm, pinholes are easily generated in the plating which makes it impractical. An extremely thick coating is also impractical.

Wax Filling Process (See FIG. 1 (*b*))

We utilized a wax 14, which is at least solid at the neighborhood of 50° C., and which is possible to remove in a heated state, because it is not required after electroplating. A mixture of rosin and paraffin is prepared as wax 14 which has a melting point of from 80°–150° C. and which has an appropriate hardness and a comparatively low contraction. The method by which the part to be the cooled water path (slit 5) of the back frame 1 is filled with the wax is that, for example, the wax is melted in a receptacle, the back frame 1 is dipped in the molten wax, with the wax being drawn up, cooled and solidified, or the back frame 1 may be horizontally disposed, making the side of the electroplating surface face upward, whereupon the molten wax is poured on into the part to be the cooled water path, and allowed to cool and solidify. Thereafter, after removing the remainder of the wax, the electroplating surface is ground to an uniform state. It is not preferable to utilize alloys having a low melting point such as Wood's alloy, etc. as the material of the mold, because a component of the Wood's alloy may elute out during activation, thereby hindering the adhesion of the plating.

The Process to Make the Surface of Wax Electrically Conductive

There are two methods by which the wax can be made electrically conductive. The first method involves the mixing and kneading of metal powders (for example copper or silver powders) or carbon powders in wax beforehand to make the wax electrically conductive. In the second method, after filling the cooling water paths in the back frame 1 with wax 14, electrically conductive powders is rubbed into the wax 14. With the first method, unless the electrically conductive powders are added in an amount of more than 50% by volume, the wax 14 is not made electrically conductive. Therefore, because it is not only very difficult to remove the wax 14 after using the first process, but, when using silver powders, a great deal is required and therefore, is not economical. Accordingly, the second method is preferable.

As the electrically conductive powder, silver powders are the most preferable because of its good conductibility of electricity and comparatively constant quality. When the silver powders have a grain size of less than 20 μm, especially good results are obtained. The method for applying silver powders to the surface of wax 14 is that, for example, the silver powders are scattered thinly on the surface to be electroplated, by rubbing in with, for example, fingers in wax 14, and accordingly, it is possible to thinly form a uniform, thin silver, layer membrane on the surface of wax 14. Although the thin silver layer membrane adheres to a part of the surface of the back frame 1, it is possible to remove it during acid-activation in the process thereafter, because the surface of 1 has less adhering power than the surface of the wax 14.

The Plating (the Electroplating) Process

After the treatment of making the wax electrically conductive, the plating (electroplating) process follows, which is shown in the sequence of the following processes.

I. Degreasing process

Alkali dipping degreasing is conducted at a temperature under 50° C. so that the wax does not soften or expand. It is not possible to use solvent degreasing, because the wax will soften or dissolve. It is also not preferable to use electrolytic degreasing, because the generated gas has the effect of making the thin silver layer on wax 14 rise partially to the surface. Preferred types of alkalis used in the degreasing process are sodium hydroxide, sodium carbonate, sodium phosphate, sodium silicate and other similar types of alkalis.

II. Rinsing process

In this process, the degreasing solution remaining after the alkali dipping degreasing step is rinsed off by using any suitable rinsing agent, e.g. water.

III. Acid-activation process

This important process involves the removal of the oxide stratum on the surface of the material of the back frame 1 in order for the plating (electroplating) to adhere to the material of the back frame 1 or to the plating stratum made beforehand. It is necessary to use an agent which dissolves and activates only the back frame 1 or the plating stratum set beforehand without dissolving the silver thin layer formed on the wax 14. As such, it is not desirable to use an acid having the property of oxidation (for example nitric acid), and the combination of an organic acid with a mineral acid, which has the property of being non-oxidizing, has been most effective with copper and also with nickel provided on the surface of the back frame 1. Electrolytic acidactivation, in which the silver thin layer rises to the surface, was unsuitable. Suitable types of mineral acids are inorganic acids such as phosphoric acid, sulfuric acid, etc. and suitable types of organic acids are oxalic acid, citric acid, tartaric acid, lactic acid, etc.

IV. Rinsing process

In this process, acid remaining on the back frame 1 from the acid-activation process is rinsed off by a suitable rinsing agent, e.g. water.

V. Plating (electroplating) process (see FIG. (*c*))

As the plating (electroplating), it is possible to use nickel and nickel alloy, and copper and copper alloy. But, because the wax 14, contained in the grooves to be the cooled water paths, is easy to expand, it is preferable to choose a plating solution which can be applied at a temperature in the neighborhood of room temperature, if possible. As such, it is preferable to use a copper sulfate bath or copper borofluoride bath. Since the working conditions are hard during the use of the mold for continuous casting, the copper plating must have excellent mechanical strength (tensile strength, power resistance) and good elongation, and it is also necessary that the utilized copper plating (electroplating) bath does not include additives such as agents to smooth or luster the plating that contain organic substances.

When plating with an organic additive, it is easy to form a crude plating stratum and generate defects such as voids in the plating stratum. Therefore, it is most effective to pulse-electrolyze or PR-electrolyze utilizing the specific electrolytic solution (the plating solution). During the electroplating process, the mold 4 and the back frame 1 are placed in a desired position with respect to each other and bonded together.

With respect to the thickness of the plated stratum, it should be more than at least 1 mm and can be up to 50 mm.

An especially preferable solution composition and plating condition are as follows:

| | |
|---|---|
| Copper sulfate bath | |
| copper sulfate (5 water salt) | 100–200 g/l |
| sulfuric acid | 80–180 g/l |
| chlorine ion | appropriate quantity |
| agitation | air |
| temperature of solution | 20–40° C. |
| condition of electrolysis | |
| on time | 1–100 msec |
| off time | 100–400 msec |
| duty cycle | 1–100% |
| average of electric current density | 0.5–20 A/dm$^2$ |
| Copper borofluoride bath | |
| copper borofluoride | 300–600 g/l |
| borofluoric acid | 1–20 g/l |
| boric acid | 5–30 g/l |
| agitation | air |
| temperature of solution | 20–60° C. |
| condition of electrolysis | |
| electric current density of cathode | 1–30 A/dm$^2$ |
| electric current density of anode | 1–40 A/dm$^2$ |
| electrolyzing time of cathode | 1–30 sec |
| electrolyzing time of anode | 0.5–20 sec |

VI. Mechanical manufacturing process After finishing the electroplating stratum by a mechanical manufacturing process, the wax 14, contained in the cooled water path (slit 5), is dissolved and removed. At this step, the silver thin layer on the wax cannot be seen from the outside since the wax 14 is completely covered by copper. This mechanical manufacturing process is required without regard to the wax removing treatment.

VII. Wax removing process (see FIG. 1 (*d*))

The wax 14 is dipped in heated water warmed to a temperature over the melting point of the wax 14, and subsequently, the wax melts and is removed. The specific gravity of wax 14 is less than that of water, therefore, after being dipped in the heated water, the wax 14 softens, melts and discharges from the cooled water path. Another method involves the feeding of steam into the cooled water path (slit 5), the wax 14 softens, melts and flows out.

VIII. Processing process

As to any processing thereafter, it is possible to apply any of the coating methods applied to conventional molds.

Figure 2:
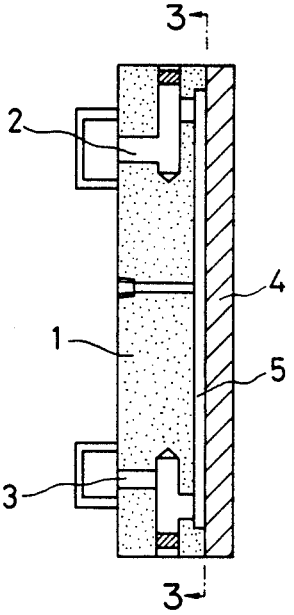
FIG. 2 is a sectional view of a mold for continuous casting manufactured according to the production method of the invention.

FIG. 2 is a sectional view of a mold produced by the method of the present invention. As shown in FIG. 2, the mold 4, comprising copper or a copper alloy, is united with the back frame 1 by the plating without using any installment holes or bolts. Accordingly, it is not necessary that the plate thickness of the mold 4 by any thicker than required for the particular metal being cast.

Figure 3:
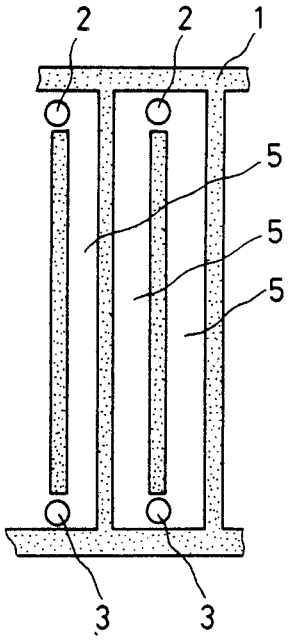
FIG. 3 is the sectional view with respect to the line A—A.
Figure 4:
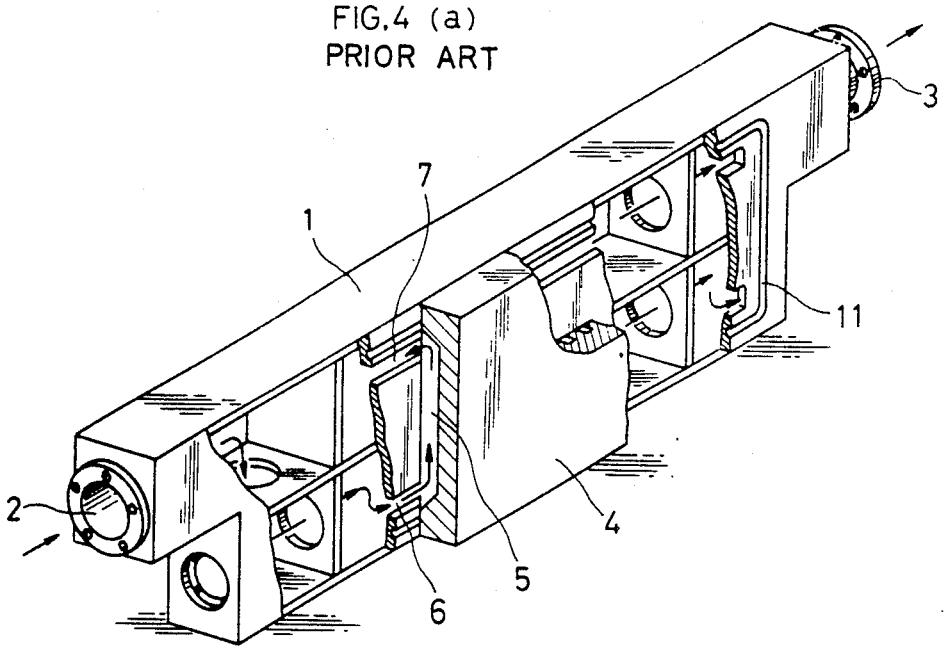
FIG. 4 (a) PRIOR ART
FIG. 4 (*a*), (*b*) are the exploded perspective views of a conventional example.
Figure 4:
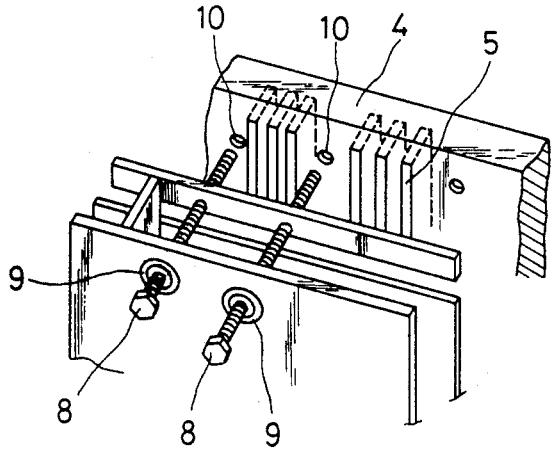
FIG. 4 (b) PRIOR ART
Figure 5:
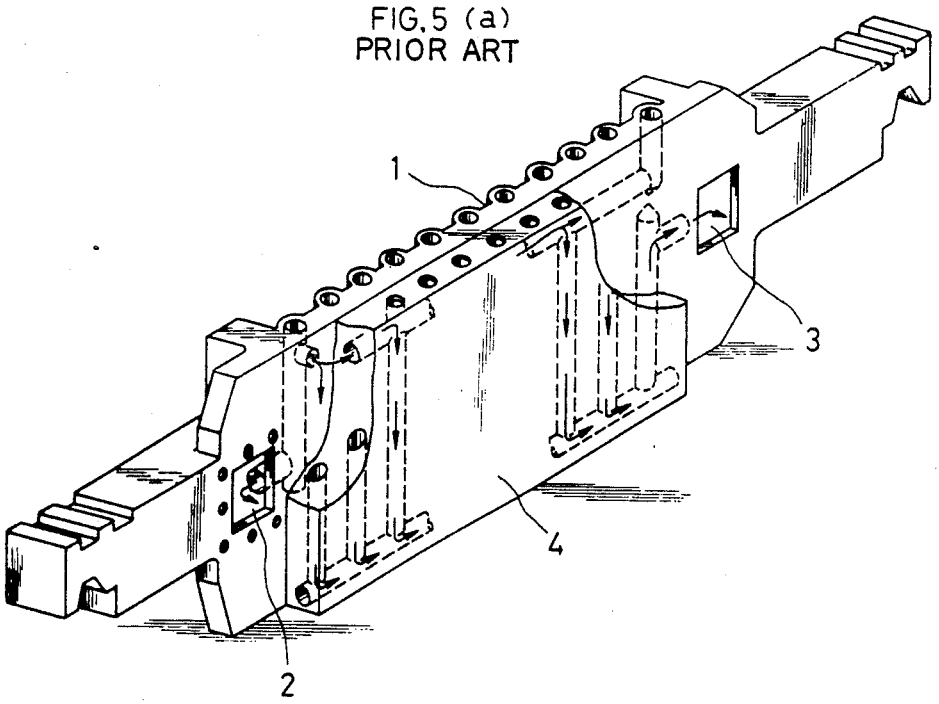
FIG. 5 (a) PRIOR ART
FIG. 5 (*a*), (*b*) are the exploded perspective views of another conventional example.
Figure 5:
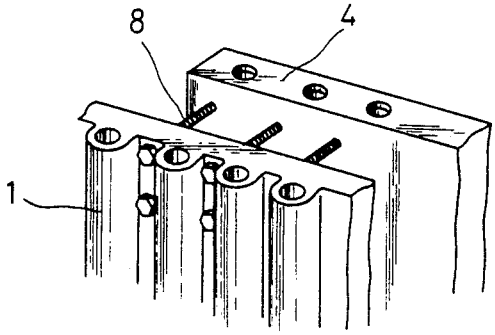
FIG. 5 (b) PRIOR ART
Figure 6:
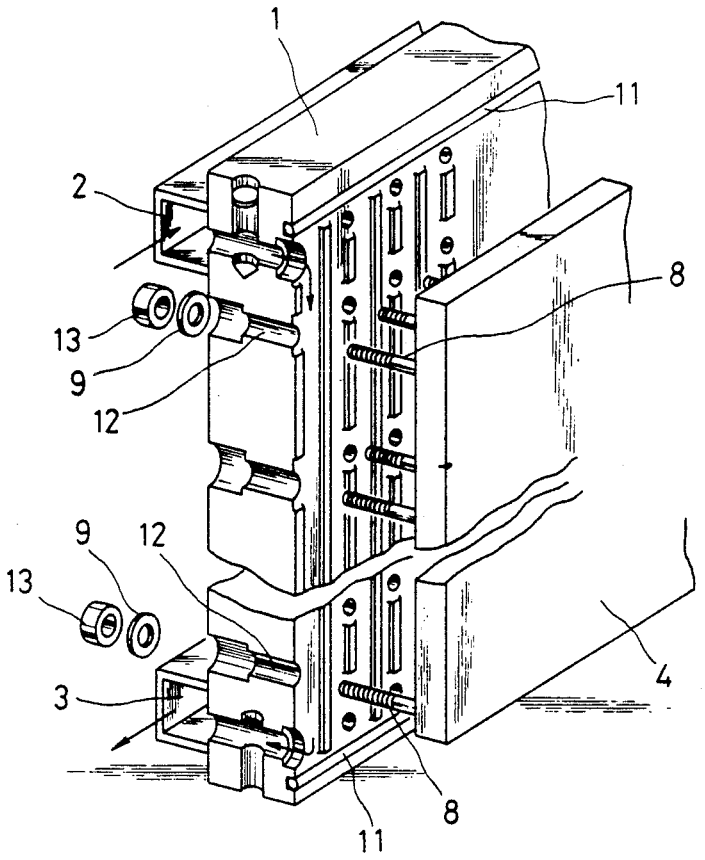
FIG. 6 PRIOR ART
FIG. 6 is the exploded perspective view of still another conventional example.

FIG. 3 is a sectional view with respect to A—A' line of FIG. 2. Because the installment holes or bolts are not required in the invention, as shown in FIG. 3, it is possible to design the cooled water path (slit 5) so as to obtain an uniform cooling effect. Also, since the back frame 1 and the mold 4 are united as one by the electrolytic plating, there is no requirement to prevent the leakage of water due to packings and O-rings. Additionally, since a copper or nickel plating is previously applied to the part to be the cooled water path (slit 5), it is possible to prevent rust, even if the back frame 1 is an iron material. Further, since the mold 4, comprising copper or a copper alloy, is initially formed by electroplating, it is possible to deposit additional copper layer, when desired, by electroplating, even when the mold is damaged during operation, and it is easy to reproduce the mold 4.

What is claimed is:

1. A method of producing a mold for continuous casting comprising the steps of:

providing cooling water paths in a surface of a mold water cooling mechanism;

filling the cooling water paths with wax to form an uniform surface;

depositing a copper or copper alloy stratum on said wax by electrolytic plating to unite said mold with said water cooling mechanism; and removing the wax from the water cooling path.

2. The method of claim 1, additionally comprising the step of providing a coating on said surface before the cooling water paths are filled with wax.

* * * * *